US005194059A

United States Patent [19]

Wu

[11] Patent Number: 5,194,059

[45] Date of Patent: Mar. 16, 1993

[54] MAGNETICALLY CONTROLLED EXERCISER FOR EXERCISING ARMS

[76] Inventor: Hong-Chi Wu, No. 523, Ta-Hsiang St., Chung-Li CIty, Taoyuan Hsien, Taiwan

[21] Appl. No.: 817,744

[22] Filed: Jan. 7, 1992

[51] Int. Cl.[5] ..... A63B 21/00

[52] U.S. Cl. ..... 482/92; 482/903; 482/102

[58] Field of Search ..... 482/903, 5, 135-138, 482/98-103, 94, 112-113, 116, 130, 133, 92

[56] References Cited

U.S. PATENT DOCUMENTS 4,834,367 5/1989 Salyer et al. ..... 482/100
4,951,943 8/1990 Farenholtz ..... 482/100

FOREIGN PATENT DOCUMENTS 3600654 7/1987 Fed. Rep. of Germany ..... 482/903

*Primary Examiner*—Robert Bahr
*Assistant Examiner*—John P. Leubecker
*Attorney, Agent, or Firm*—Baker & Daniels

[57] ABSTRACT

An exerciser for exercising arms includes a frame assembly and an input mechanism which has a pull rope. The pull rope has a fixed end and a movable end connected to an arm exercising mechanism. A suspended pulley set includes a pulley seat on which an upper pulley and a lower pulley are mounted. The pull rope extends around the upper portion of the lower pulley, while a guide rope extends around the lower portion of the upper pulley. The guide rope is fixed on the frame assemby at an end thereof. When the pull rope is pulled, the suspended pulley set moves downward so as to rotate an intermediate drive wheel. An endless flexible driving element is trained between the intermediate drive wheel and a driven wheel so as to rotate the driven wheel. A resistance setting unit is disposed on the frame assembly and can be adjusted so that a generator unit creates a predetermined amount of electric current, thereby activating a magnetic controller to change magnetic resistance to the rotation of the driven wheel. A spiral spring connects the rotating shaft of the driven wheel to the frame assembly so as to rotate the rotating shaft to a normal position, thereby moving the suspended pulley set to an upper limit position. The resistance setting unit may be a rotary knob.

9 Claims, 6 Drawing Sheets

MAGNETICALLY CONTROLLED EXERCISER FOR EXERCISING ARMS

BACKGROUND OF THE INVENTION

1. Field of the Invention

This invention relates to an exerciser for exercising arms, more particularly to an exerciser which is equipped with a magnetically controlled resistance generating device.

2. Description of the Related Art

A conventional exerciser is designed to exercise arm muscles by indirectly pulling one end of a rope. A selected number of stacked cast iron masses are attached to the other end of the rope in order to create a resistance to the rope pulling action. When one desires to change the magnitude of the resistance, the number of the cast iron masses must be increased or reduced. The conventional exerciser suffers from the following drawbacks:

(1) Upward and downward movement of the cast iron masses causes collision of the same, thereby producing too much noise.

(2) The cast iron masses are attached to the rope by pins. It is time-consuming to mount and dismount the cast iron masses from the rope.

(3) Since no shield encloses the cast iron masses, one may be injured when approaching the cast iron masses during its alternative upward and downward movement.

SUMMARY OF THE INVENTION

It is therefore the object of this invention to provide an exerciser with a magnetically controlled resistance generating device which can be easily adjusted to change the resistance to the rope pulling action.

According to this invention, an exerciser for exercising arms includes a frame assembly and an input mechanism which has a pull rope. The pull rope has a fixed end and a movable end connected to an arm exercising mechanism. A suspended pulley set includes a pulley seat on which an upper pulley and a lower pulley are mounted. The pull rope extends around the upper portion of the lower pulley, while a guide rope extends around the lower portion of the upper pulley. The guide rope is fixed on the frame assembly at an end thereof. When the pull rope is pulled, the suspended pulley set moves downward so as to rotate an intermediate drive wheel. An endless flexible driving element is trained between the intermediate drive wheel and a driven wheel so as to rotate the driven wheel. A resistance setting unit is disposed on the frame assembly and can be adjusted so that a generator unit creates a predetermined amount of electric current, thereby activating a magnetic controller to change magnetic resistance to the rotation of the driven wheel. A spiral spring connects the rotating shaft of the driven wheel to the frame assembly so as to rotate the rotating shaft to a normal position, thereby moving the suspended pulley set to an upper limit position. The resistance setting unit may be a rotary knob.

BRIEF DESCRIPTION OF THE DRAWING

Other features and advantages of this invention will become apparent in the following detailed description of the preferred embodiments of this invention, with reference to the accompanying drawings, of which.

DETAILED DESCRIPTION OF THE PREFERRED EMBODIMENTS

Figure 1:
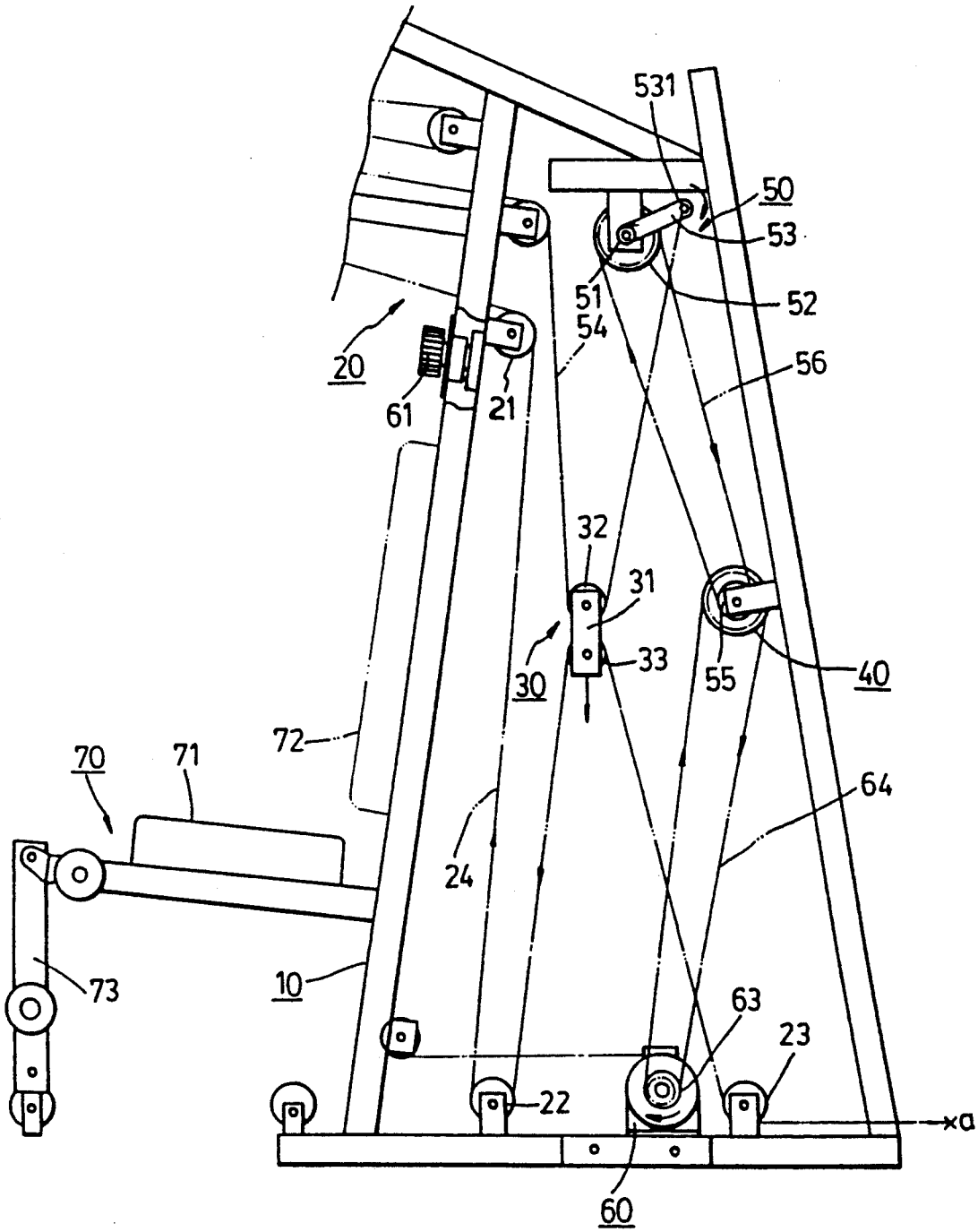
FIG. 1 illustrates an exerciser for exercising arms according to a first embodiment of this invention.
Figure 2:
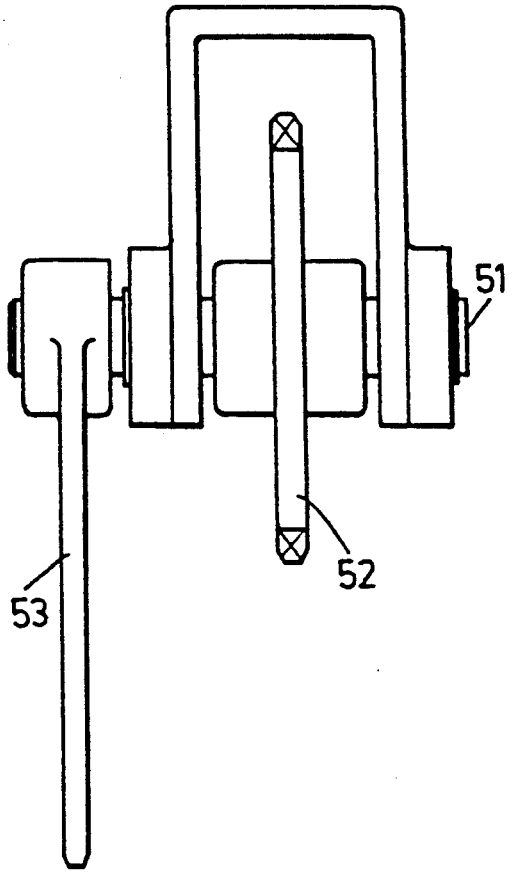
FIG. 2 illustrates the crank unit of the exerciser according to the first embodiment of this invention.
Figure 3:
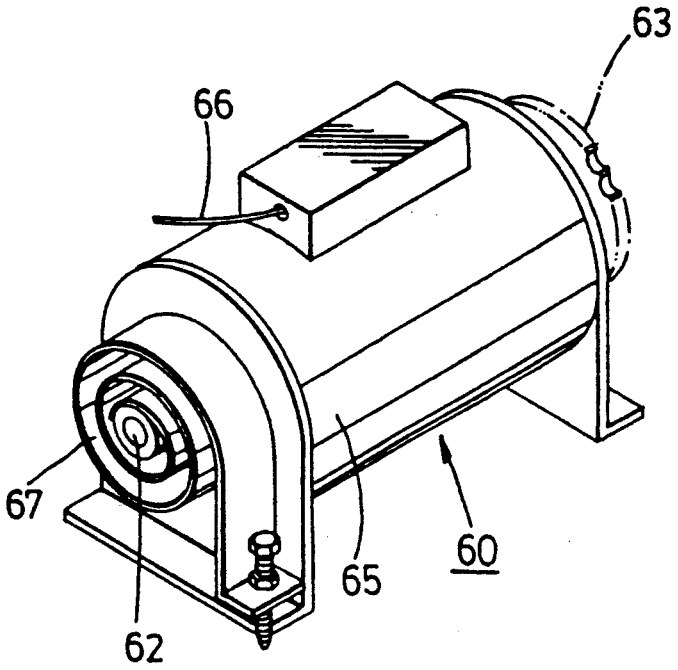
FIG. 3 is a perspective view showing the magnetic controller of the exerciser according to the first embodiment of this invention.

Referring to FIG. 1, an exerciser of this invention is designed to exercise legs and arms. As illustrated, the exerciser includes a frame assembly (10), an input mechanism (20), a suspended pulley set (30), an intermediate drive wheel (40), a drive mechanism (50), a resistance generating device (60) and a leg exercising mechanism (70). The leg exercising mechanism (70) has a conventional structure which consists of a seat (71), a back rest (72) and an operating unit (73). The suspended pulley set (30) includes a pulley seat (31), an upper pulley (32) mounted on the pulley seat (31), and a lower pulley (33) mounted on the pulley seat (31) under the upper pulley (32). The intermediate drive wheel (40) is mounted on the rear portion of the frame assembly (10).

The input mechanism (20) includes an input pulley (21), a front guide pulley (22), a rear guide pulley (23) and a pull rope (24). The input pulley (21) is mounted on the front upper portion of the frame assembly (10). The front guide pulley (22) is mounted on the front lower end portion of the frame assembly (10). The rear guide pulley (23) is mounted on the rear lower end portion of the frame assembly (10). The pull rope (24) is fixed at a point (a) on the rear end portion of the frame assembly (10) and extends around the upper portion of the input pulley (21), the lower portion of the front guide pulley (22), the upper portion of the lower pulley (33) and the lower portion of the rear guide pulley (23). As illustrated, the front end portion of the pull rope (24) extends forward from the input pulley (21) and has a front end (not shown) which is connected to an arm exercising mechanism (not shown).

The resistance generating device (60) includes a resistance setting unit or rotary knob (61), a rotating shaft (62), a driven wheel (63), an endless driving element (64), a magnetic controller (65), an electric wire (66) and a spiral spring (67). The rotary knob (61) is disposed on the front upper portion of the frame assembly (10). The rotating shaft (62) is journalled on the lower end portion of the frame assembly (10). The driven wheel (63) is sleeved rigidly on the rotating shaft (62). In this embodiment, the intermediate drive wheel (40) and the driven wheel (63) are sprockets. The driving element (64) is a chain which is trained between the intermediate drive wheel (40) and the driven wheel (63). The driven wheel (63) has a diameter smaller than that of the intermediate drive wheel (40) so as to rotate the driven wheel (63) at a speed greater than that of the intermediate drive wheel (40). The sprocket and chain unit may be replaced with a pulley and V-belt unit. The magnetic controller (65) is disposed on the rotating shaft (62) and is connected to the rotary knob (61) by means of the electric wire (66). A generator unit (not shown) is provided on the magnetic controller (65) so as to create electric current in the magnetic controller (65), thereby offering a magnetic resistance to the rotation of the rotating shaft (62) when the pull rope (24) is pulled. The magnitude of the magnetic resistance can be selected by rotating the rotary knob (61). The spring (67) connects the rotating shaft (62) to the frame assembly (10) so as to bias the rotating shaft (20) to rotate to a normal position, in which the suspended pulley set (30) is moved to its upper limit position.

The drive mechanism (50) includes a crank shaft (51), a driving pulley (52), a crank arm (53), a guide rope (54), a small pulley (55) and a V-belt (56). The crank shaft (51) is journalled on the rear upper end portion of the frame assembly (10). The driving pulley (52) is sleeved rigidly on the crank shaft (51). The crank arm (53) is connected securely to the crank shaft (51) at an end thereof, and has a crank pin (531) at the other end of the crank arm (53). The guide rope (54) is fastened to the crank pin (531) of the crank arm (53) at a first end thereof and to a third exercising mechanism (not shown) at a second end thereof. The third exercising mechanism is provided on the front upper end portion of the frame assembly (10). When the third exercising mechanism is idle, the second end of the guide rope (54) is fixed on the frame assembly (10) and may be regarded as a fixed end, while the first end is movable during movement of the pull rope (24) and may be regarded as a movable end. The small pulley (55) is secured to and is coaxial with the intermediate drive wheel (40). The V-belt [56) is trained between the driving pulley (52) and the small pulley (55) so as to transfer the rotation of the driving pulley (52) to the small pulley (55). As illustrated, the small pulley (55) has a diameter smaller than that of the driving pulley (52) so as to rotate the small pulley (55) at a speed greater than that of the driving pulley (52).

It can be appreciated that the magnetic resistance can be easily adjusted by operating the rotary knob (61). Furthermore, the adjustment to the rotary knob (61) is a very quiet operation. Moreover, the resistance generating device (60) cannot injure any person approaching thereto.

Figure 4:
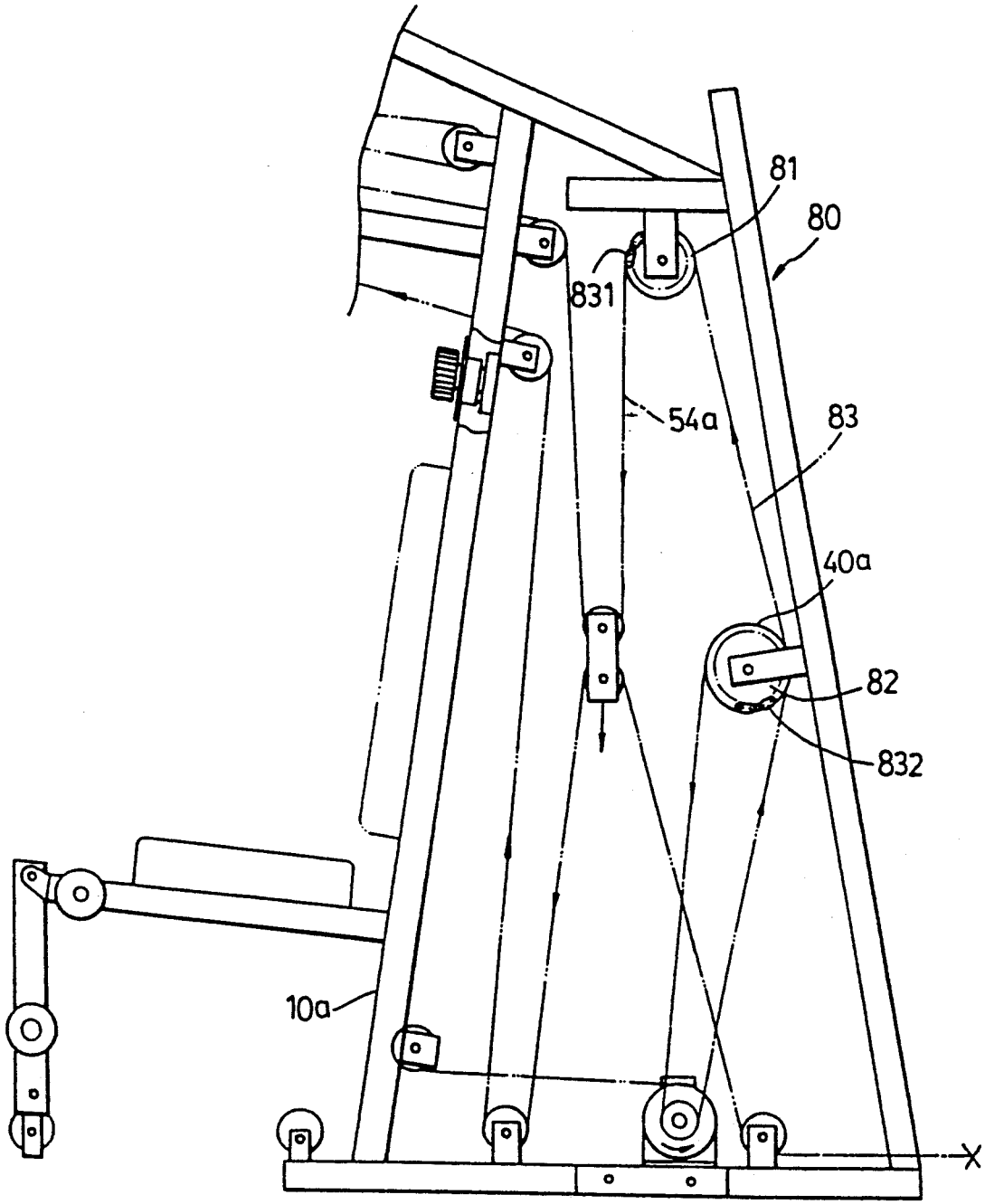
FIG. 4 illustrates an exerciser for exercising arms according to a second embodiment of this invention.

FIG. 4 shows another exerciser of this invention which is similar to the first embodiment in construction except that the drive mechanism (50) is modified. As illustrated, the modified drive mechanism (80) includes a guide rope (54*a*), a guide sprocket (81), a drive sprocket (82) and a chain (83). The guide sprocket (81) is mounted rotatably on the upper end portion of the frame assembly (10*a*). The drive sprocket (82) is secured to and is coaxial with the intermediate drive pulley (40*a*). The chain (83) extends around the upper portion of the guide sprocket (81) and has a first end portion (831) connected securely to the movable end of the guide rope (54*a*), and a second end portion (832) extending around and engaging a portion of the drive sprocket (82). The second end portion (832) of the chain (83) has a distal end which is fastened to the drive sprocket (82).

Figure 5:
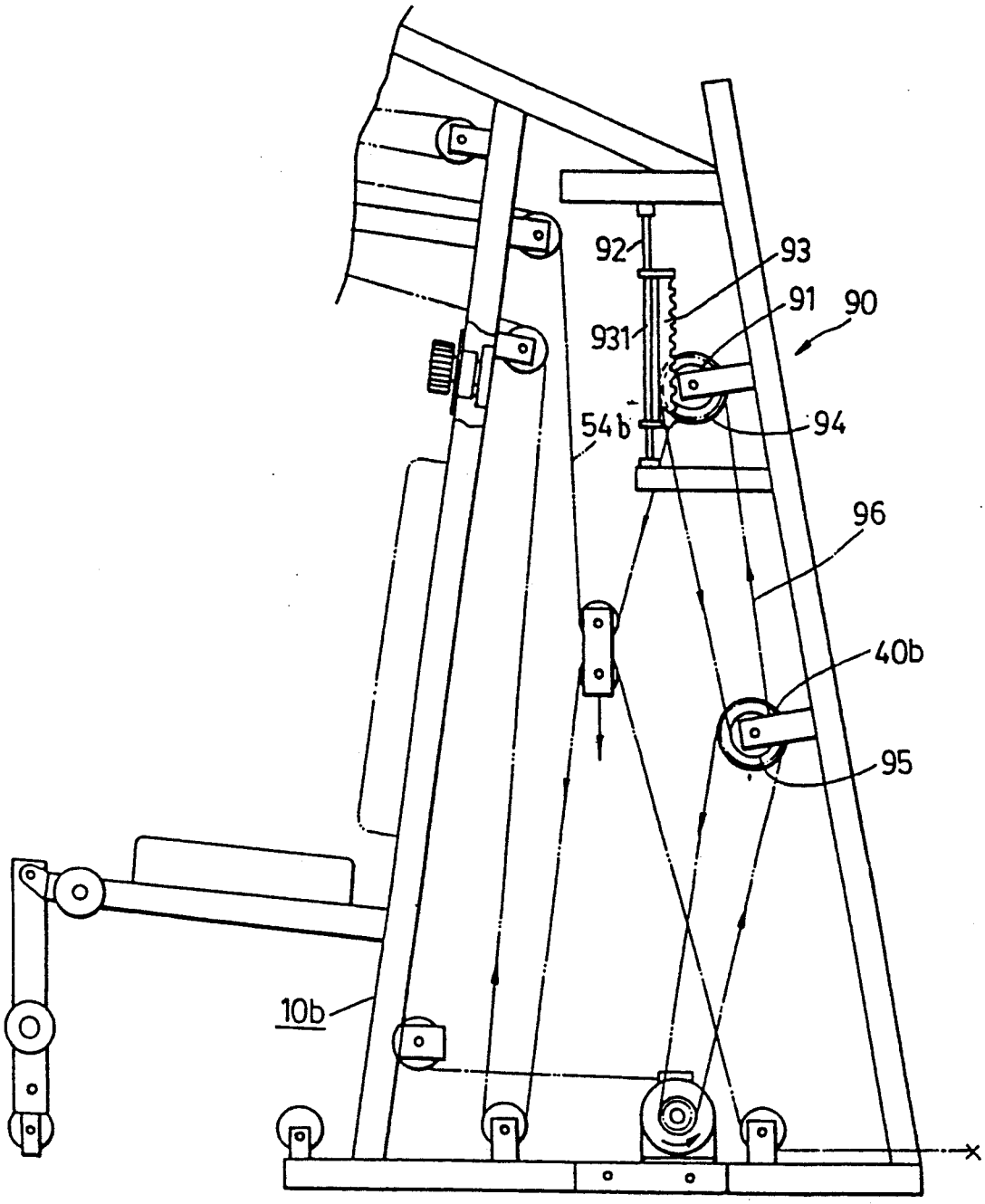
FIG. 5 illustrates an exerciser for exercising arms according to a third embodiment of this invention.
Figure 6:
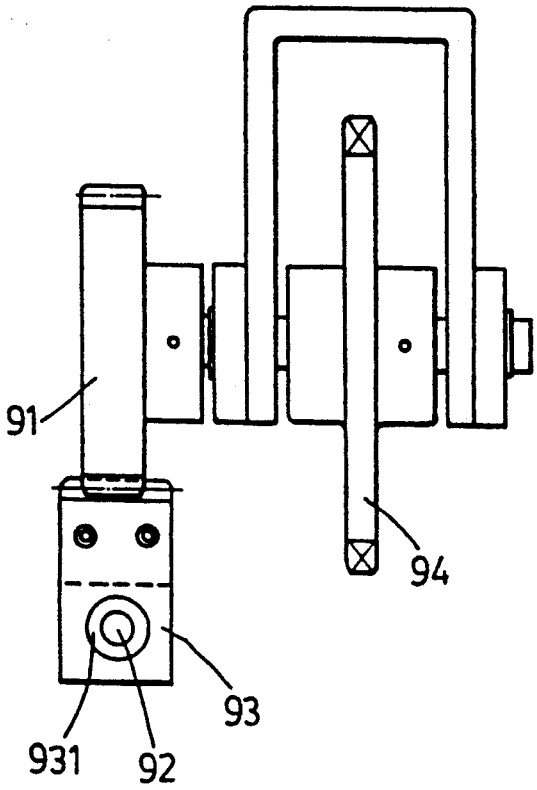
FIG. 6 illustrates the engagement of the rack and the pinion of the exerciser according to the third embodiment of this invention.

FIG. 5 shows another modified drive mechanism (90) which includes a guide rope (54*b*), a pinion (91), a guide rod (92), a rack unit (93), a driving sprocket (94), a drive sprocket (95) and an endless chain (96). The pinion (91) is mounted rotatably on the upper end portion of the frame assembly (10*b*). The guide rod (92) is secured to the frame assembly (10*b*) near the pinion (91). The rack unit (93) engages the pinion (91) and has a sliding sleeve (931) sleeved on the guide rod (92). The guide rope (54*b*) is fastened to the lower end of the rack unit (93). A driving sprocket (94) is secured to and is coaxial with the pinion (91). A drive sprocket (95) is secured to and is coaxial with the intermediate wheel (40*b*). An endless chain (96) is trained between the driving sprocket (94) and the drive sprocket (95) so as to transfer the rotation of the driving sprocket (94) to the drive sprocket (95). The drive sprocket (95) has a diameter smaller than that of the driving sprocket (94) so as to rotate the drive sprocket (95) at a speed greater than that of the driving sprocket (94).

With this invention thus explained, it is apparent that numerous modifications and variations can be made without departing from the scope and spirit of this invention. It is therefore intended that this invention be limited only as indicated in the appended claims.

I claim:

1. An exerciser for exercising arms, comprising:

a frame assembly:

an input mechanism including an input pulley mounted on a front upper portion of said frame assembly, a front guide pulley mounted on a lower end portion of said frame assembly, and a pull rope extending around a lower portion of said front guide pulley and around an upper portion of said input pulley, said pull rope having a fixed end secured to a rear portion of said frame assembly and a front end adapted to be connected to an arm exercising mechanism;

a suspended pulley set including a pulley seat, an upper pulley mounted rotatably on said pulley seat, and a lower pulley mounted rotatably on said pulley seat under said upper pulley, said pull rope extending around an upper portion of said lower pulley:

an intermediate drive wheel mounted rotatably on said frame assembly;

a drive mechanism interconnecting said suspended pulley set and said intermediate drive wheel and including a guide rope extending around a lower portion of said upper pulley of said suspended pulley set, said guide rope having a movable end and a fixed end secured to an upper end portion of said frame assembly so as to move said suspended pulley set upward and downward, thereby rotating said intermediate drive wheel; and a resistance generating device including a resistance setting unit disposed on said frame assembly, a rotating shaft journalled on said frame assembly, a driven wheel sleeved rigidly on said rotating shaft, an endless driving element trained between said intermediate drive wheel and said driven wheel so as to transfer rotation of said intermediate drive wheel to said driven wheel, a magnetic controller connected functionally to said rotating shaft and said resistance setting device so as to create a predetermined magnetic resistance to rotation of said rotating shaft during reciprocal movement of said pull rope, and a spiral spring connecting said rotating shaft to said frame assembly so as to bias said rotating shaft to rotate to a normal position, thereby moving said suspended pulley set to an upper limit position.

2. An exerciser as claimed in claim 1, wherein said driven wheel of said resistance generating device has a diameter smaller than that of said intermediate drive wheel so as to rotate said driven wheel at a speed greater than that of said intermediate drive wheel.

3. An exerciser as claimed in claim 1, wherein said drive mechanism includes:

a crank shaft journalled on the upper end portion of said frame assembly;

a driving pulley sleeved rigidly on said crank shaft;

a crank arm connected securely to said crank shaft at an end thereof and having a crank pin at the other end thereof;

said movable end of guide rope being fastened to said crank pin;

a small pulley secured coaxially to said intermediate drive wheel; and a V-belt trained between said driving pulley and said small pulley so as to transfer rotation of said driving pulley to said small pulley.

4. An exerciser as claimed in claim 3, wherein said small pulley has a diameter smaller than that of said driving pulley so as to rotate said small pulley at a speed greater than that of said driving pulley.

5. An exerciser as claimed in claim 1, wherein said drive mechanism includes:

a guide sprocket mounted rotatably on the upper end portion of said frame assembly;

a drive sprocket secured coaxially to said intermediate drive pulley; and a chain extending around and engaging an upper portion of said guide sprocket and having a first end portion connected securely to said movable end of said guide rope, and a second end portion extending around and engaging a portion of said drive sprocket, said second end portion of said chain having a distal end which is fastened to said drive sprocket.

6. An exerciser as claimed in claim 1, wherein said drive mechanism includes:

a pinion mounted rotatably on the upper end portion of said frame assembly;

a guide rod disposed on said frame assembly near said pinion;

a rack unit mounted slidably on said guide rod so as to engage with said pinion;

said movable end of said guide rope being fastened to a lower end of said rack unit;

a driving sprocket secured coaxially to said pinion;

a drive sprocket secured coaxially to said intermediate drive pulley; and an endless chain trained between said driving sprocket and said drive sprocket so as to transfer rotation of said driving sprocket to said drive sprocket.

7. An exerciser as claimed in claim 6, wherein said drive sprocket has a diameter smaller than that of said driving sprocket so as to rotate said drive sprocket at a speed greater than that of said driving sprocket.

8. An exerciser as claimed in claim 1, wherein said resistance setting unit includes a rotary knob mounted on said frame assembly.

9. An exerciser as claimed in claim 1, wherein said intermediate drive wheel and said driven wheel are sprockets, said driving element being a chain.

* * * * *